US005472838A

United States Patent [19]

Helling et al.

[11] Patent Number: 5,472,838

[45] Date of Patent: Dec. 5, 1995

[54] PROCESS FOR THE PRODUCTION OF A SILVER HALIDE EMULSION

[75] Inventors: Günter Helling, Odenthal; Klaus Wagner, Bergisch Gladbach, both of Germany

[73] Assignee: Agfa-Gevaert AG, Leverkusen, Germany

[21] Appl. No.: 272,669

[22] Filed: Jul. 11, 1994

Related U.S. Application Data

[63] Continuation-in-part of Ser. No. 206,642, Mar. 7, 1994, abandoned.

[30] Foreign Application Priority Data

Mar. 16, 1993 [DE] Germany ..... 43 08 323.4

[51] Int. Cl.[6] ..... G03C 1/005

[52] U.S. Cl. ..... 430/569; 430/607; 430/609; 430/621; 430/614; 430/634; 430/631; 430/638

[58] Field of Search ..... 430/569, 607, 430/609, 621, 614, 634, 631, 638

[56] References Cited

U.S. PATENT DOCUMENTS

| | | | |
|---|---|---|---|
| 4,434,226 | 2/1984 | Wilgus et al. | 430/569 |
| 4,439,520 | 3/1984 | Kofron et al. | 430/569 |
| 5,215,879 | 6/1993 | Suzuki et al. | 430/569 |

FOREIGN PATENT DOCUMENTS

| | | |
|---|---|---|
| 0124425 | 10/1978 | Japan . |
| 0019981 | 5/1986 | Japan . |

OTHER PUBLICATIONS

Research Disclosure, Dec. 1989, Item 308119, Sections I and XVII, pp. 993–995 and 1009, Ananymous.

*Primary Examiner*—Thomas R. Neville

*Attorney, Agent, or Firm*—Connolly & Hutz

[57] ABSTRACT

Silver halide emulsions with tabular grains showing increased aspect ratio are produced by adding to the precipitiation vessel a compound of the formula I:

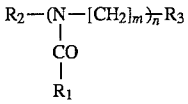

(I)

in which $R_1$ means H or optionally substituted alkyl, aralkyl or cycloalkyl $R_2$ means H or optionally substituted alkyl, aryl or aralkyl or a polymer chain $R_3$ means H, OH, alkyl, aryl, aralkyl, halogen, $NHR_4$, O—CO—$R_4$, O—CO—$NHR_4$ or an optionally substituted oxazoline ring $R_4$ means optionally substituted or alkyl, aralkyl or aryl m means 2 or 3, n means 2 to 10,000, or a compound of the formula II

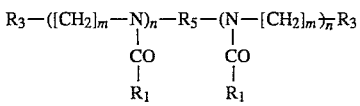

(II)

in which $R_1$, $R_3$, n and m have the meaning stated above and may be identical or different and $R_5$ means optionally substituted alkene, arylene, aralkene or a polyaddition, polycondensation or polymerisation chain.

8 Claims, No Drawings

PROCESS FOR THE PRODUCTION OF A SILVER HALIDE EMULSION

This is a continuation-in-part application of Ser. No. 08/206,642 filed Mar. 7, 1994, now abandoned.

The invention provides a process for the production of a silver halide emulsion and particularly of a silver halide emulsion which contains tabular silver grains.

By the process of the invention the proportion of tabular silver halide grains or the aspect ratio of the tabular silver halide grains or both are increased.

This is accomplished by adding to the reaction vessel wherein the silver halide is precipitated before precipitation is started a compound of the general formulae I or II.

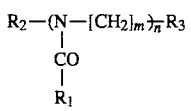

(I)

in which $R_1$ means H or optionally substituted alkyl, aralkyl or cycloalkyl $R_2$ means H or optionally substituted alkyl, aryl or aralkyl or a polymer chain $R_3$ means H, OH, alkyl, aryl, aralkyl, halogen, $NHR_4$, O—CO—$R_4$, O—CO—$NHR_4$ or an optionally substituted oxazoline ring $R_4$ means optionally substituted or alkyl, aralkyl or aryl m means 2 or 3, preferably 2 n means 2 to 10,000, preferably 5 to 2,000;

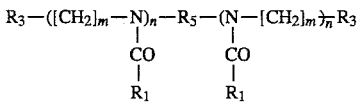

(II)

in which $R_1$, $R_3$, n and m have the meaning stated above and may be identical or different and $R_5$ means optionally substituted alkene, arylene, aralkene or a polyaddition, polycondensation or polymerisation chain.

$R_1$ may vary within a polymer, such that copolymers, block copolymers or graft polymers are possible.

The compounds of the formulae (I) and (II) are preferably water soluble or dispersible in water. Compounds of formula (I) are preferred.

Preferred compounds have substituents with the following meanings:

$R_1$ $C_1$–$C_4$ alkyl, in particular $CH_3$, $R_2$ optionally substituted $C_1$–C20 alkyl, wherein phenyl and sulphamoyl may in particular be considered as substituents, $R_3$ OH.

The polyaddition, polycondensation or polymerisation compounds $R_5$ are, for example, polyesters, preferably aliphatic polyesters, polyacetals, polyethers, polyamides, polyester amides, polycarbonates, polyurethanes, polystyrenes, poly(meth)acrylates, optionally substituted polyacrylamides, polyalkene compounds.

The compounds have a molecular weight from approximately 300 to 20,000, preferably 500 to 5,000.

Polyethers which may be cited are, for example, the polymerisation products of ethylene oxide, propylene oxide, tetrahydrofuran, butylene oxide and their copolymerisation or graft polymerisation products, together with the condensation products obtained by condensation of polyhydric alcohols or mixtures of such condensation products, and the products obtained by alkoxylation of polyhydric alcohols.

Polyacetals which may be considered are, for example, the compounds which may be produced from hexanediol and formaldehyde. Suitable polyesters, polyester amides and polyamides are the predominantly linear condensation products obtained from polybasic saturated carboxylic acids and polyhydric saturated alcohols, amino alcohols, diamines and mixtures thereof.

Polymerisation products which may be mentioned are polystyrene, substituted polystyrenes, poly(meth)acrylates such as polybutyl acrylate, polyethyl acrylate, polyhydroxyethyl acrylate, polymethyl methacrylate, polyethyl methacrylate, optionally substituted polyacrylamides or polymethacrylamides, polyvinyl ethers, polyethylene, polypropylene, polyisobutylene.

The synthesis of compounds I and II is described in *Macromolecules,* vol. 19, no. 6, 1986, p. 1547, *Polymer Bulletin,* 13, 447 (1985), *Macromol. Chem., Macromol. Symp.* 1, 23–37 (1986), *Macromolecules* 1986, 19, 535 and *Macromolecules* 1973, 6, 805.

According to Japanese published patent application JP-OS 78/124 425, the compounds have previously been used in the photographic industry as an additive to bleaching baths or to silver halide materials in order to improve bleachability. According to this reference these compounds were not added before precipitation of the silver halide.

Examples of compounds according to the invention are

P-1

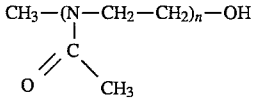

n ~ 10

P-2

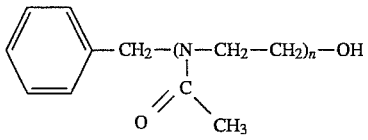

n ~ 15

P-3

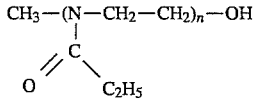

n ~ 500

P-4

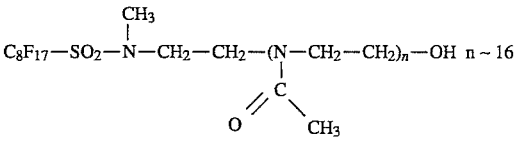

n ~ 16

P-5

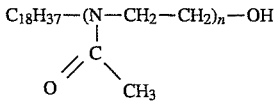

n ~ 30

P-6

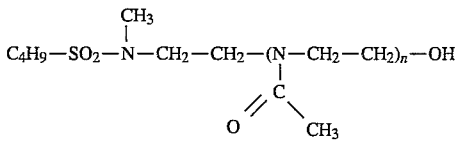

n ~ 25

-continued

P-7

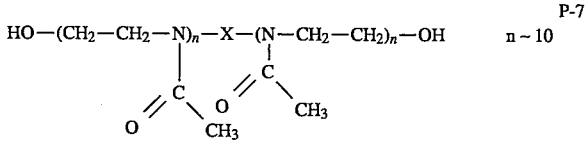

X=polyester made from adipic acid and butanediol; $M_n$ (by terminal group determination) approx. 2,000

P-8

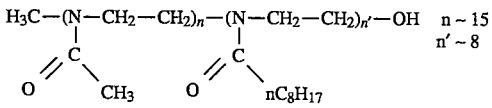

P-9

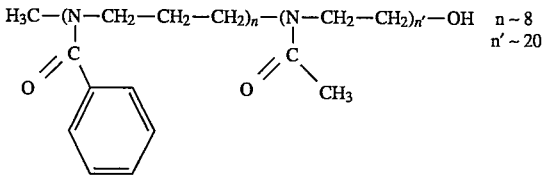

P-10

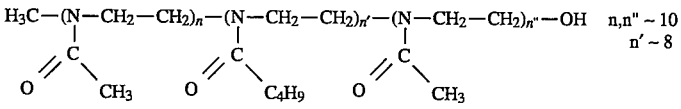

P-11

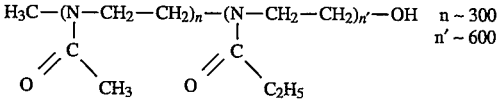

P-12

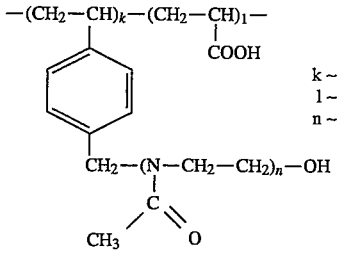

P-13

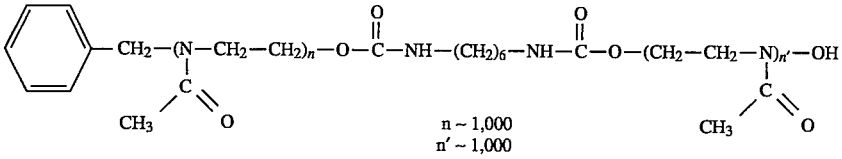

The precipitation of the silver halides for photographic purposes is usually accomplished in the presence of a binder.

Gelatine is preferably used as the binder. Gelatine may, however, be entirely or partially replaced with other synthetic, semi-synthetic or also naturally occurring polymers. Synthetic gelatine substitutes are, for example, polyvinyl alcohol, poly-N-vinyl pyrrolidone polyacrylamides, polyacrylic acid and the derivatives thereof, in particular the copolymers thereof. Naturally occurring gelatine substitutes are, for example, other proteins such as albumin or casein, cellulose, sugar, starch or alginates. Semi-synthetic gelatine substitutes are usually modified natural products. Cellulose derivatives such as hydroxyalkyl cellulose, carboxymethyl cellulose and phthalyl cellulose together with gelatine derivatives obtained by reaction with alkylating or acylating agents or by grafting polymerisable monomers, are examples of such products.

The binders should have a sufficient quantity of functional groups available so that satisfactorily resistant layers may be produced by reaction with suitable hardeners. Such functional groups are in particular amino groups, but also carboxyl groups, hydroxyl groups and active methylene groups.

The preferably used gelatine may be obtained by acid or alkaline digestion. Oxidised gelatine may also be used. The production of such gelatines is described, for example, in *The Science and Technology of Gelatine,* edited by A. G. Ward and A. Courts, Academic Press 1977, pages 295 et seq.

The gelatine used in each case should have a content of photographically active impurities which is as low as possible (inert gelatine). Gelatines with high viscosity and low swelling are particularly advantageous.

The compounds of formulae I or II are used in an amount of from 0.1 to 20 % by weight based on the amount of binder, particularly gelatine, present during the precipitation of the silver halide, preferably in an amount of from 0.5 to 5 % by weight.

The silver halide present in the photographic material as the photosensitive constituent may contain chloride, bromide or iodide or mixtures thereof as the halide. For example, the halide content of at least one layer may consist of 0 to 15 mol % iodide, 0 to 100 mol % chloride and 0 to 100 mol % bromide. In the case of colour negative and colour reversal films, silver bromide-iodide emulsions are customarily used, in the case of colour negative and colour reversal paper, silver chloride-bromide emulsions with a high chloride content up to pure silver chloride emulsions are customarily used. The crystals may be compact, for example regularly cubic or octahedral, or they may have transitional shapes. Preferably, however, tabular crystals are prepared, the average ratio of diameter to thickness of which is preferably at least 5:1, wherein the diameter of a grain is defined as the diameter of a circle the contents of which correspond to the projected surface area of the grain.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. A homodisperse grain size distribution means that 95% of the grains do not deviate by more than ± 30% from the average grain size. The emulsions may, in addition to the silver halide, also contain organic silver salts, for example silver benzotriazolate or silver behenate.

Two or more types of silver halide emulsions which are produced separately may be used as a mixture.

The photographic emulsions may be produced by various methods (for example P. Glafkides, *Chimie et Physique Photographique,* Paul Montel, Paris (1967), G. F. Duffin, *Photographic Emulsion Chemistry,* The Focal Press, London (1966), V. L. Zelikman et al, *Making and Coating Photographic Emulsion,* The Focal Press, London (1966) from soluble silver salts and soluble halides.

Precipitation of the silver halide preferably proceeds in the presence of the binder, e.g. gelatine, and may be performed in an acid, neutral or alkaline pH range, wherein silver halide complexing agents are preferably additionally used. Such agents include, for example, ammonia, thioether, imidazole, ammonium thiocyanate or excess halide. The water-soluble silver salts and the halides are brought together optionally consecutively using the single jet process or simultaneously using the double jet process or by any combination of both processes. Feeding is preferably performed with rising inflow rates, wherein the 'critical' feed rate, at which no further new nuclei are formed, should not be exceeded. The pAg range may vary within wide limits during precipitation, the so-called pAg-controlled process is preferably used in which a specific pAG value is held constant or a defined pAg profile is followed during precipitation. In addition to the preferred precipitation with a halide excess, so-called inverse precipitation with a silver ion excess is, however, also possible. Apart from by precipitation, the silver halide crystals may also grow by physical ripening (Ostwald ripening) in the presence of excess halide and/or a silver halide complexing agent. Growth of the emulsion grains may even predominantly proceed by Ostwald ripening, wherein preferably a fine grained, so-called Lippmann emulsion is mixed with a more sparingly soluble emulsion and redissolved onto it.

Salts or complexes of metals such as Cd, Zn, Pb, Tl, Bi, Ir, Rh, Fe may also be present during precipitation and/or physical ripening of the silver halide grains.

Precipitation may furthermore also proceed in the presence of sensitising dyes. Complexing agents and/or dyes may be made ineffective at any desired point in time, for example by altering the pH value or by oxidative treatment.

On completion of crystal formation, or also at an earlier point in time, the soluble salts are eliminated from the emulsion, for example by noodling and washing, by flocculation and washing, by ultrafiltration or by ion exchangers.

The silver halide emulsion is generally subjected to chemical sensitisation under defined conditions—pH, pAg, temperature, gelatine concentration, silver halide concentration and sensitiser concentration—until optimum sensitivity and fog are achieved. The procedure is described in, for example, H. Frieser, *Die Grundlagen der Photographischen Prozesse mir Silberhalogeniden,* pages 675– 734, Akademische Verlagsgesellschaft (1968).

At this stage, chemical sensitisation may proceed with the addition of compounds of sulphur, selenium, tellurium and/or compounds of metals of subgroup VIII of the periodic table (e.g. gold, platinum, palladium, iridium), furthermore there may be added thiocyanate compounds, surface-active compounds, such as thioethers, heterocyclic nitrogen compounds (for example imidazoles, azaindenes) or also spectral sensitisers (described, for example, in F. Hamer, *The Cyanine Dyes and Related Compounds,* 1964, or *Ullmanns Encyclopädie der technischen Chemie,* 4th edition, volume 18, pages 431 et seq, and *Research Disclosure* 17643 (December 1978), section III). Alternatively or additionally, reduction sensitisation may be performed by adding reducing agents (tin(II) salts, amines, hydrazine derivatives, aminoboranes, silanes, formamidinesulphinic acid), by hydrogen, by low pAg (for example, less than 5) and/or high pH (for example, greater than 8).

The photographic emulsions may contain compounds to prevent fogging or to stabilise the photographic function during production, storage or photographic processing.

Particularly suitable are azaindenes, preferably tetra and pentaazaindenes, particularly those substituted with hydroxyl or amino groups. Such compounds have been described, for example, by Birr, *Z. Wiss. Phot.,* 47, (1952), pages 2–58. Furthermore, salts of metals such as mercury or cadmium, aromatic sulphonic or sulphinic acids such as benzenesulphinic acid, or heterocyclics containing nitrogen such as nitrobenzimidazole, nitroindazole, optionally substituted benzotriazoles or benzothiazolium salts may also be used as anti-fogging agents. Particularly suitable are heterocyclics containing mercapto groups, for example mercaptobenzothiazoles, mercaptobenzimidazoles, mercaptotetrazoles, mercaptothiadiazoles, mercaptopyrimidines, wherein these mercaptoazoles may also contain a water solubilising group, for example a carboxyl group or sulpho group. Further suitable compounds are published in *Research Disclosure* 17643 (December 1978), section VI.

The stabilisers may be added to the silver halide emulsions before, during or after ripening of the emulsions.

Naturally, the compounds may also be added to other photographic layers which are assigned to a silver halide layer.

Mixtures of two or more of the stated compounds may also be used.

The photographic silver halide emulsions produced according to the invention may contain surface-active agents for various purposes, such as coating auxiliaries, to prevent formation of electric charges, to improve sliding properties, to emulsify the dispersion, to prevent adhesion and to improve photographic characteristics (e.g. acceleration of development, high contrast, sensitisation, etc.). Apart from natural surface-active compounds, for example saponin, it is mainly synthetic surface-active compounds (surfactants) which are used: non-ionic surfactants, for example alkene oxide compounds, glycerol compounds or glycidol compounds, cationic surfactants, for example higher alkylamines, quaternary ammonium salts, pyridine compounds and other heterocyclic compounds, sulphonium compounds or phosphonium compounds, anionic surfactants containing an acid group, e.g. carboxylic acid, sulphonic acid, a phosphoric acid, sulphuric acid ester or phosphoric acid ester group, ampholytic surfactants, for example amino acid and aminosulphonic acid compounds together with sulphuric or phosphoric acid esters of an amino alcohol.

The photographic emulsions may be spectrally sensitised by using methine dyes or other dyes. Particularly suitable dyes are cyanine dyes, merocyanine dyes and complex merocyanine dyes.

An overview of the polymethine dyes suitable as spectral sensitisers, suitable combinations of the dyes and the combinations with supersensitising effects is contained in *Research Disclosure* 17643 (December 1978), section IV.

In particular, the following dyes—classified by spectral range—are suitable:

1. as red sensitisers
   9-ethylcarbocyanines with benzothiazole, benzoselenazole or naphthothiazole as basic terminal groups, which may be substituted in 5th or 6th position by halogen, methyl, methoxy, carbalkoxy, aryl, together with 9-ethyl-naphthoxathia- or -selenocarbocyanines and 9-ethyl-naphthothiaoxa- or -benzoimidazocarbocyanines, provided that the dyes bear at least one sulphoalkyl group on the heterocyclic nitrogen.
2. as green sensitisers
   9-ethylcarbocyanines with benzoxazole, naphthoxazole or a benzoxazole and a benzothiazole as basic terminal groups, together with benzimidazolecarbocyanines, which may also be further substituted and must also contain at least one sulphoalkyl group on the heterocyclic nitrogen.
3. as blue sensitisers
   symmetrical or asymmetrical benzimidiazo-, oxa-, thia- or selenocyanines with at least one sulphoalkyl group on the heterocyclic nitrogen and optionally further substituents on the aromatic ring, together with apomerocyanines with a rhodanine group.

The silver halide emulsions prepared according to this invention are useful for the production of photographic elements, particularly color photographic elements according to suitable and well-known techniques.

EXAMPLE 1

Emulsion 1 (EM 1)

An aqueous solution of 30 g of inert bone gelatine, 36 g of KBr and 3.2 g of KI in 3 1 of water were introduced into a 10 1 reaction vessel.

1200 ml of an aqueous solution of 136 g of $AgNO_3$ and 1200 ml of an aqueous solution of 150 g of KBr and 6.8 g of KI were added, each at a constant rate, to this initial solution over a period of 30 minutes.

After an interval of 10 minutes, a further 1600 ml of an aqueous solution of 204 g of $AgNO_3$ and 1600 ml of an aqueous solution of 130 g of $NH_4Br$ were added over a period of 32 minutes at a constant rate.

The emulsion was then cooled and flocculated by acidification and adding a flocculating agent. The flocculate was washed several times and redispersed with the addition of inert bone gelatine such that a silver/gelatine weight ratio of 1:0.3 (related to silver nitrate) was produced.

The emulsion obtained in this manner had an average grain diameter of 0.8 μm and an iodide content of 3 mol %.

On the basis of electron micrographs, the proportion of tabular crystals in the total projected area was approximately 35%. The average aspect ratio of the tabular crystals was 3.5. EM 1 is a comparison emulsion.

EM 2 (according to the invention)

EM 2 was produced in the same way as EM 1 with the difference that the initial solution additionally contained 0.34 g of compound P 3. The proportion of tabular crystals in the total projected area was 85% and the average aspect ratio of the tabular crystals was 7.5.

EM 3 (according to the invention)

EM 3 was produced in the same way as EM 1 with the difference that the initial solution additionally contained 1.36 g of compound P 3. The proportion of tabular crystals in the total projected area was 95% and the average aspect ratio of the tabular crystals was 17.

EM 4 (according to the invention)

EM 4 was produced in the same way as EM 1 with the difference that the initial solution additionally contained 3.4 g of compound P 3. The proportion of tabular crystals in the total projected area was 97% and the average aspect ratio of the tabular crystals was>25.

Emulsions EM 1 to EM 4 were optimally ripened with gold and sulphur compounds, stabilised with 5 mmol of 4-hydroxy- 6-methyl-1,3,3a,7-tetraazaindene per mol of $AgNO_3$ and spectrally sensitised with red sensitiser S 1. The following photographic elements 1 to 4, differing only in the type of emulsion used, were then produced. The support was cellulose triacetate; the quantities are per 1 $m^2$. The photographic elements were processed by exposure, color development, bleaching, fixing, rinsing and drying in the usual way. The optimum amount of sensitiser, fog, relative red sensitivity and relative blue sensitivity were tested.

Layer 1 (Anti-halo layer)
Black colloidal silver sol prepared from
0.4 g Ag and
3.0 g gelatine.
Layer 2 (Interlayer)
0.5 g gelatine
Layer 3 (Red sensitive layer)
Red sensitised emulsion according to Table 1
prepared from
5.1 g $AgNO_3$
6.0 g gelatine
2.4 g cyan coupler BG 1
Layer 4 (Interlayer)
1.0 g gelatine
Layer 5 (Hardening layer)
0.24 g gelatine
0.3 g hardener of the formula

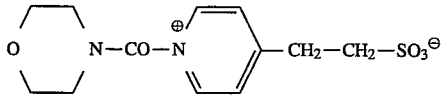

TABLE 1

| Emulsion | Optimum amount of red sensitiser S1 [μmol/mol Ag] | Fog | Relative red sensitivity | Relative blue sensitivity |
|---|---|---|---|---|
| EM1 | 250 | 0.25 | 100 | 100 |
| EM2 | 320 | 0.23 | 123 | 102 |
| EM3 | 390 | 0.21 | 148 | 100 |

TABLE 1-continued

| Emulsion | Optimum amount of red sensitiser S1 [μmol/mol Ag] | Fog | Relative red sensitivity | Relative blue sensitivity |
|---|---|---|---|---|
| EM4 | 440 | 0.18 | 132 | 98 |

Red sensitiser S 1:

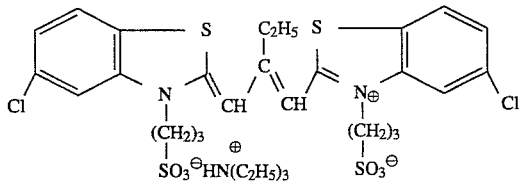

Cyan coupler BG 1

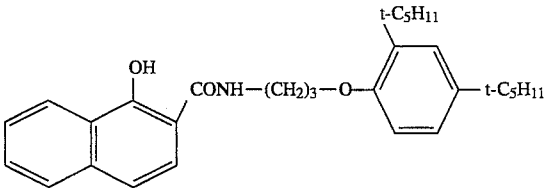

With the compounds according to the invention the amount of tabular grains and their aspect ratio are increased. This leads as demonstrated to improvements in fog and relative red sensitivity without an undesired increase in blue sensitivity.

We claim:

1. Process for the preparation of a silver halide emulsion by reacting an alkali halide and silver nitrate in aqueous solution in a reaction vessel in the presence of a binder characterised in that a compound of formula I or II is added to the reaction vessel before the precipitation of the silver halide starts

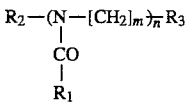

(I)

in which $R_1$ means H or alkyl, aralkyl or cycloalkyl $R_2$ means H or unsubstituted or substituted alkyl by phenyl or sulphamoyl, aryl, aralkyl or a polymer chain $R_3$ means H, OH, alkyl, aryl, aralkyl, halogen, $NHR_4$, O—CO—$R_4$, O—CO—$NHR_4$ or an oxazoline ring $R_4$ means alkyl, aralkyl or aryl m means 2 or 3, means 2 to 10,000;

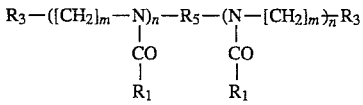

(II)

in which $R_1$, $R_3$, n and m have the meaning stated above and may be identical or different and $R_5$ means alkene, arylene, aralkene or a polyaddition, polycondensation or polymerisation chain.

2. Process according to claim 1 characterised in that a compound of formula I is added in which $R_1$ means $C_1$–$C_4$ alkyl, $R_2$ means unsubstituted or substituted $C_1$–C20 alkyl wherein the substitutents are phenyl or sulphamoyl and $R_3$ means OH.

3. Process according to claim 1, characterised in that the compound of formula I or II is added in an amount of from 0.1 to 20 % by weight based on the amount of binder, present during the precipitation of the silver halide.

4. The process as claimed in claim 1, wherein m is 2 and n is 5 to 2,000.

5. The process as claimed in claim 2, wherein $R_1$ is $CH_3$ and $R_2$ is a $C_1$–$C_{20}$ alkyl substituted by phenyl or sulphamoyl.

6. The process as claimed in claim 1, wherein $R_5$ is aliphatic polyester, polyacetal, polyether, polyamide, polyester amide, polycarbonate, polyurethane, polystyrene, poly-(methy)acrylate, polyalkene or polyacrylamide.

7. The process as claimed in claim 1, wherein the compounds of formula I or formula II have a molecular weight from approximately 300 to 20,000.

8. The process as claimed in claim 3, wherein the compounds of formula I or formula II have a molecular weight from approximately 500 to 5,000.

* * * * *